US010448138B2

(12) United States Patent
Tsai

(10) Patent No.: US 10,448,138 B2
(45) Date of Patent: Oct. 15, 2019

(54) POWER-SAVING EARPHONE

(71) Applicant: MERRY ELECTRONICS (SHENZHEN) CO., LTD., Shenzhen, Guangdong (CN)

(72) Inventor: Ming-Hung Tsai, Taichung (TW)

(73) Assignee: MERRY ELECTRONICS (SHENZHEN) CO., LTD., Shenzhen, Guangdong (CN)

( * ) Notice: Subject to any disclaimer, the term of this patent is extended or adjusted under 35 U.S.C. 154(b) by 0 days.

(21) Appl. No.: 15/996,218

(22) Filed: Jun. 1, 2018

(65) Prior Publication Data

US 2019/0208306 A1 Jul. 4, 2019

(30) Foreign Application Priority Data

Dec. 29, 2017 (TW) ..... 106146425 A

(51) Int. Cl.

| | |
|---|---|
| ***H04R 1/10*** | (2006.01) |
| ***H01H 3/00*** | (2006.01) |
| ***H01H 1/24*** | (2006.01) |
| ***H01H 9/02*** | (2006.01) |
| *H04R 5/02* | (2006.01) |

(52) U.S. Cl.

CPC ..... *H04R 1/1041* (2013.01); *H01H 1/24* (2013.01); *H01H 3/00* (2013.01); *H01H 9/0271* (2013.01); *H04R 1/1016* (2013.01); *H04R 1/1025* (2013.01); *H01H 2003/007* (2013.01); *H01H 2239/018* (2013.01); *H01H 2239/048* (2013.01)

(58) Field of Classification Search

CPC .. H04R 1/1041; H04R 1/1016; H04R 1/1025; H01H 1/24; H01H 9/0271

USPC ..... 381/74, 309

See application file for complete search history.

(56) References Cited

U.S. PATENT DOCUMENTS

| | | | | |
|---|---|---|---|---|
| 2014/0016803 A1* | 1/2014 | Puskarich | ..... | H04R 1/1041 381/309 |
| 2015/0063617 A1* | 3/2015 | Yoon | ..... | H04R 1/1041 381/328 |
| 2016/0157008 A1* | 6/2016 | Zhang | ..... | H04R 5/04 381/74 |

* cited by examiner

*Primary Examiner* — Vivian C Chin
*Assistant Examiner* — Ammar T Hamid
(74) *Attorney, Agent, or Firm* — Muncy, Geissler, Olds & Lowe, PC

(57) ABSTRACT

A power-saving earphone includes a casing, an audio member, a sensing member, and an elastic soft sheath. The casing has first and second grounding paths provided separately. The audio member is disposed in the casing and includes a processing unit electrically connected with the first grounding path. The sensing member includes a controlling unit electrically connected with the second grounding path. The elastic soft sheath is disposed on the casing and capable of being elastically deformed by an external force. When the elastic soft sheath is not deformed, the first and second grounding paths form an open circuit. When the elastic soft sheath is elastically deformed by the external force, the elastic soft sheath electrically connects the first and second grounding paths, enabling the sensing member to function.

11 Claims, 5 Drawing Sheets

POWER-SAVING EARPHONE

BACKGROUND OF THE INVENTION

1. Field of the Invention

The present invention relates to an earphone and more particularly, to a touch control earphone, which can effectively save power when not in use, prolonging available time of the whole earphone.

2. Description of the Related Art

With the development of consumer electronic products, more and more electronic products use touch sensitive keys to replace traditional mechanical keys. For the application in energy-conserving and power-saving products, touch control chip manufactures all try hard to reduce the electric current consumption of the touch control chip as low as possible, and unceasingly optimize software and hardware to attain microampere (μA)-grade power consumption. That undoubtedly injects new vitality into the rapidly changing consumer electronic products.

As to the traditional earphone using the mechanical key, no matter how the mechanical key is designed, the mechanical key certainly occupies a part of space and surface area of the casing of the earphone and increases difficulty in designing the casing of the earphone. This is relatively unfavorable for the current earphone trend towards light/thin appearance design. Besides, the mechanical key still has other problems such as short life in usage, light leakage, mechanical sound interference by key actuation, and collecting dirt. Therefore, more and more earphones are designed with touch sensitive keys.

Although the earphone using the touch sensitive key is more likely to have compact components, that effectively minimize the volume of the earphone (ex. light/thin appearance), the earphone using the touch sensitive key needs constant power supply to the touch control chip of the touch control key for the maintenance of regular operation of the touch control key. Therefore, the low power consumption of the touch control chip itself constantly consumes the power of the battery in the earphone, shortening the available time of the whole earphone. Especially for the earphone having a small-capacity battery, this power consumption problem will be severer and severer. Therefore, how to effectively lower the power consumption of the earphone when it is not in use so as to prolong the available time of the whole earphone, is a critical problem the dealers of earphone designing want to figure out.

SUMMARY OF THE INVENTION

Accordingly, it is one of the objectives of the present invention to make an improvement aimed to the power consumption problem of the traditional earphone, thereby providing a design of earphone which can effectively lower the power consumption of the earphone when it is not in use.

Therefore, embodiments according to the present invention provides a power-saving earphone which includes a casing, an audio member, a sensing member, and an elastic soft sheath. The casing has a first grounding path and a second grounding path separately disposed on an exterior surface of the casing. The audio member includes a processing unit electrically connected with the first grounding path. The sensing member includes a controlling unit electrically connected with the second grounding path. The elastic soft sheath is disposed on the periphery of the casing and capable of being elastically deformed by an external force. When the elastic soft sheath is not deformed, the elastic soft sheath, the first grounding path and the second grounding path form an open circuit, so the sensing member can't be operated. That reduces the power consumption of the sensing member. In contrast, when the elastic soft sheath is elastically deformed by the external force, the first grounding path is electrically connected with the second grounding path through the elastic soft sheath, thereby enabling the sensing member to function for controlling the audio member to perform the commands such as shutting down the music or lowering the volume.

As a result, the sensing member is enabled to function or not depends on whether the earphone is wore. That effectively solves the power consumption problem when the earphone is not in use, so that earphone designers can have much more room to design the earphone on the basis of using the sensing member such as the touch sensitive key, solving the high power consumption problem of the earphone and prolonging the available time of the earphone.

In an aspect of the present invention, the present invention is not only applicable in the in-ear monitor, but also applicable in the headphone.

In another aspect, the elastic soft sheath has a sleeve portion and an outer cover connected with the sleeve portion, and the sleeve portion of the elastic soft sheath is sleeved onto the casing. Besides, the outer cover has an electrically conductive portion annularly provided on the outer edge of the elastic soft sheath. Therefore, under the condition that the outer cover is deformed by the external force, the electrically conductive portion of the outer cover can be in contact with and electrically connected with the first and second grounding paths.

In another aspect, at least the following two methods can be adopted to make the first and second grounding paths electrically connected with each other. One of the methods is that the whole elastic soft sheath is made of electrically conductive material, so that when the elastic soft sheath is elastically deformed, the elastic soft sheath can directly contact and electrically connect the first and second grounding paths. The second method is the sleeve portion of the elastic soft sheath is made of electrically insulating material, but the outer cover is made of electrically conductive material or coated with an electrically conductive material layer on a surface of the outer cover, so that when the elastic soft sheath is elastically deformed, the outer cover or the electrically conductive material layer of the elastic soft sheath can contact and electrically connect the first and second grounding paths. No matter which electrically connecting method is used, the processing unit and the controlling unit can be electrically connected, enabling the sensing member to function.

In another aspect, if the structural type of the earphone is in-ear monitor in configuration, the casing includes a sound tube and a main body connected with the sound tube. The exterior surface of the sound tube has a first section and a second section aligned axially. The first and second grounding paths are extended from an inner wall of the main body to the first section of the sound tube. The sleeve portion of the elastic soft sheath is sleeved onto and covers the second section of the sound tube and exposes the first section of the sound tube, so that when the elastic soft sheath is deformed by the external force, the elastic soft sheath can contact and electrically connect the first and second grounding paths located on the first section.

In parts of the embodiments, the power source may be a rechargeable battery, enhancing the convenience in usage and avoiding the problem of complicated wiring. Besides, the power source is coupled between the processing unit and the controlling unit.

In parts of the embodiments, the sensing member includes a touch control key provided at an appropriate position on the exterior surface of the casing; the controlling unit includes a touch control chip electrically connected with the touch control key, so that the touch control chip can detect the electric capacity differences on the touch control key, thereby controlling the audio member accordingly.

Preferably, the first grounding path and the second grounding path may be made by conductive wire, metal sheet or electrically conductive coated film (virtual metal).

DETAILED DESCRIPTION OF THE INVENTION

For the detailed description of the technical features of the present invention, two embodiments and the accompanying drawings are given herein below.

Figure 1:
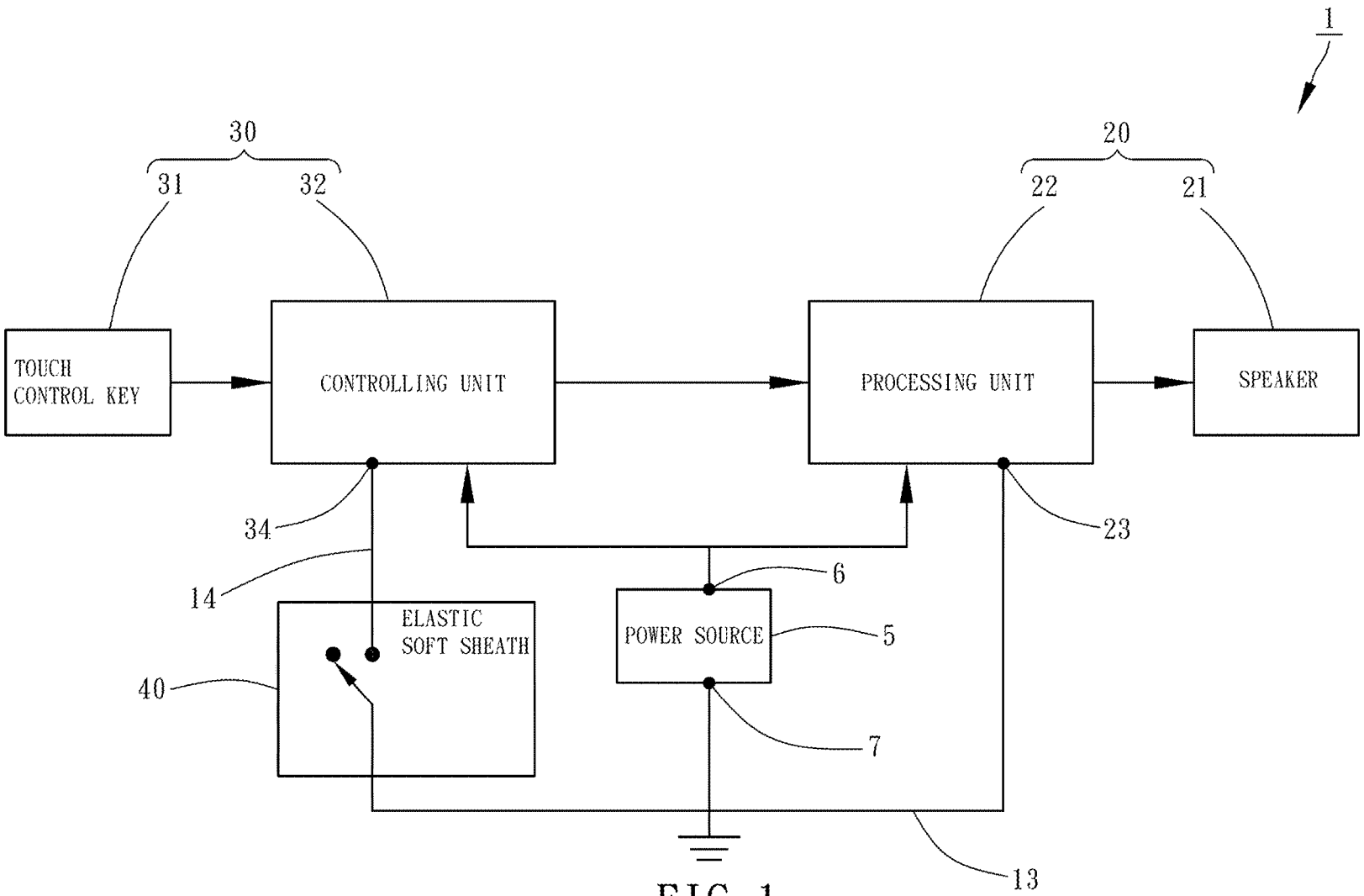
FIG. 1 is a block diagram showing the components of the earphone according to a first embodiment of the present invention.
Figure 2:
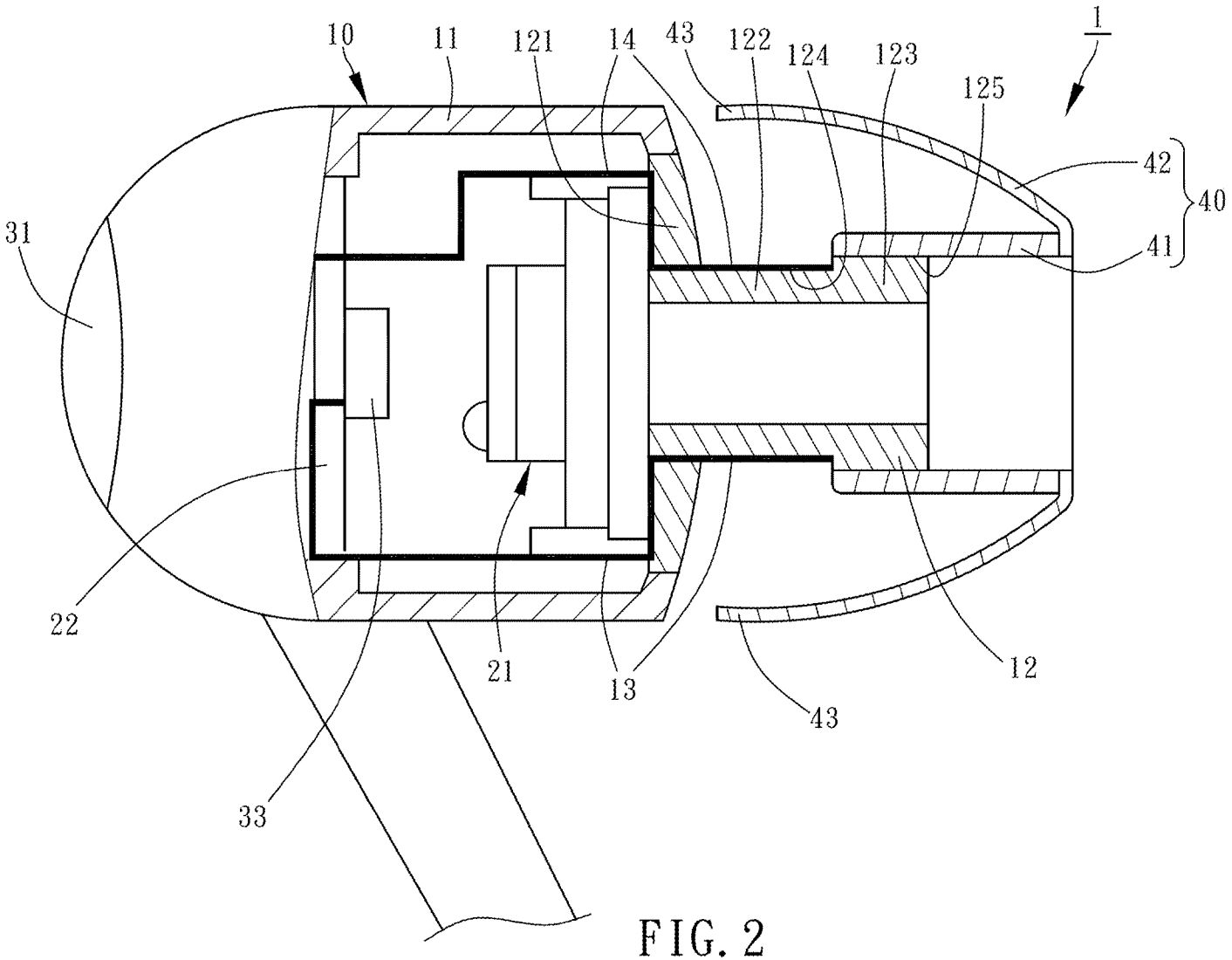
FIG. 2 is a schematic sectional view of the earphone according to the first embodiment of the present invention, showing the condition that an elastic soft sheath is not deformed.

Referring to FIG. 1 and FIG. 2, a first embodiment according to the present invention provides a power-saving earphone 1 capable of being driven by a power source 5 to emit sound. The components of the earphone 1 include a casing 10, an audio member 20, a sensing member 30, and an elastic soft sheath 40. The features of the embodiment are illustrated below.

The casing 10 primarily includes a main body 11, a sound tube 12, a first grounding path 13, and a second grounding path 14. The main body 11 is hollow-shaped for accommodating the audio member 20 and the sensing member 30. The sound tube 12 is connected with the main body 11 and communicates with an inside of the main body 11. The sound tube 12 structurally includes an installing portion 121, a large radius portion 123, and a small radius portion 122 connecting the installing portion 121 and the large radius portion 123. The large radius portion 123 and the small radius portion 122 are arranged along the axis of the sound tube 12. The exterior surface of the sound tube 12 can be divided into a first section 124 and a second section 125, wherein the first section 124 is provided on the small radius portion 122 and the second section 125 is provided on the large radius portion 123. The first grounding path 13 and the second grounding path 14 are both extended from the inner wall of the main body 11 to the first section 124 of the sound tube 12, and they are separately provided. The main body 11 and the sound tube 12 are both made of electrically insulating material such as plastics. The first and second grounding paths 13 and 14 in this embodiment are made by conductive wire. Alternatively, they may be made of sheet metal or electrically conductive coated film (i.e. virtual metal).

The audio member 20 is disposed in the main body 11. The audio member 20 includes a speaker 21 and a processing unit 22. The processing unit 22 is electrically connected with the first grounding path 13, and the processing unit 22 is a signal processor in this embodiment. The speaker 21 is provided therein with elements such as voice coils and a diaphragm (not shown), and the speaker 21 faces toward the sound tube 12. The processing unit 22 can receive an external control signal so as to control the voice coils, thereby making the diaphragm output sound, stop outputting sound, increase or decrease the output sound volume. The processing unit 22 of the audio member 20 is electrically connected with a positive voltage terminal 6 of the power source 5, and the audio member 20 uses the electric power of the power source 5 to drive the speaker 21 and the processing unit 22. Besides, the processing unit 22 further has a ground terminal 23 electrically connected with the first grounding path 13.

It should be mentioned that the power source 5 also has a ground terminal 7 electrically connected with the first grounding path 13. The power source 5 in this embodiment is a rechargeable battery. Alternatively, the power source 5 may be the supply mains.

The sensing member 30 includes a touch control key 31 and a controlling unit 32. The touch control key 31 is provided on the exterior surface of the main body 11, and the controlling unit 32 is disposed in the main body 11. In this embodiment, the controlling unit 32 includes a touch control chip 33 electrically connected with the touch control key 31. When the user performs a gesture to the touch control key 31 or touches the touch control key 31, the touch control chip 33 can detect the electric capacity differences on the touch control key 31 and transfer the electric capacity differences to the corresponding control signal and output the control signal to the audio member 20, thereby controlling the audio member 20. The controlling unit 32 of the sensing member 30 is electrically connected with the positive voltage terminal 6 of the power source 5. That means, the power source 5 is coupled between the processing unit 22 and the controlling unit 32. The controlling unit 32 of the sensing member 30 is driven by the power of the power source 5. Besides, the controlling unit 32 has a ground terminal 34 electrically connected with the second grounding path 14.

Figure 3:
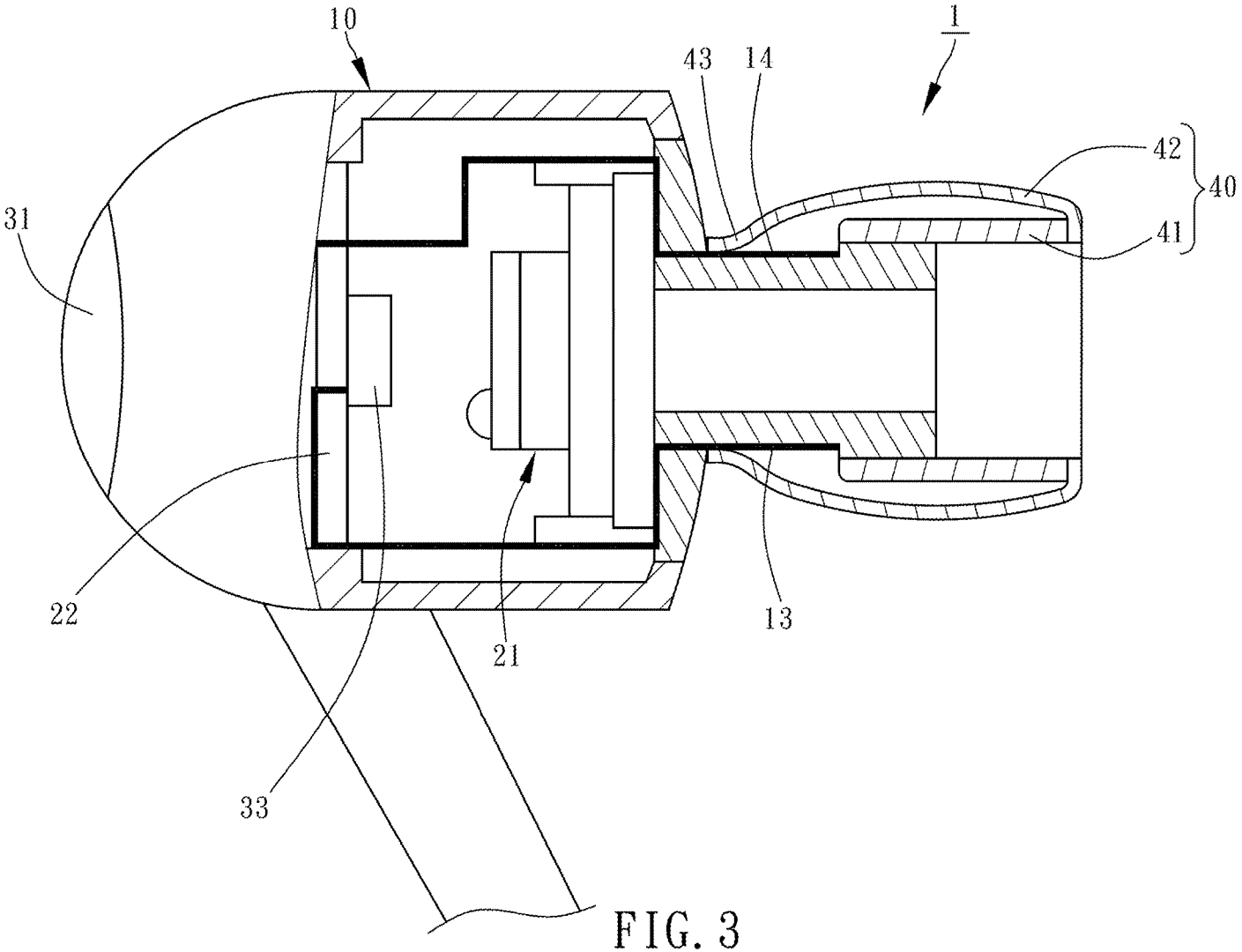
FIG. 3 is similar to FIG. 2, showing the condition that the elastic soft sheath is deformed and in contact with first and second grounding paths.

Referring to FIG. 2, the elastic soft sheath 40 structurally includes a sleeve portion 41 and an outer cover 42, wherein the sleeve portion 41 is pipe-shaped so that the sleeve portion 41 of the elastic soft sheath 40 can be sleeved onto and covers the second section 125 of the large radius portion 123 of the sound tube 12, exposing the first section 124 of the sound tube 12. The outer cover 42 is connected with the sleeve portion 41, and adapted for being in contact with the auditory meatus of the ear of the user. The outer cover 42 has an electrically conductive portion 43 annularly provided on the outer edge of the outer cover 42. The outer cover 42 is made of soft and elastically deformable material. The sleeve portion 41 is made of electrically insulating material, so the sleeve portion 41 is electrically insulated from the large radius portion 123. When the user doesn't wear the earphone 1, the elastic soft sheath 40 is not deformed as shown in FIG. 2. At this time, the electrically conductive portion 43 is not in contact with the first grounding path 13 and the second grounding path 14; the electrically conductive portion 43, the first grounding path 13 and the second grounding path 14 form an open circuit. When the user wears the earphone 1, the outer cover 42 is squeezed by the force applied by the ear of the user and thereby elastically deformed as shown in FIG. 3. At this time, the electrically conductive portion 43 is in contact with the first grounding path 13 and the second grounding path 14, so that the electrically conductive portion 43, the first grounding path 13 and the second grounding path 14 are electrically connected with each other, thereby enabling the sensing member 30 to function.

It should be mentioned that the outer cover 42 may be another structural design that the outer cover 42 is coated with an electrically conductive material layer (not shown) on the surface of the outer cover 42, so that the outer cover 42 can be electrically connected with the first and second grounding paths 13 and 14.

When the earphone 1 is not in use, which means the user doesn't wear the earphone 1, the earphone 1 may be in switched-off mode, sleep mode or switched-on mode (but not wore by the user). Owing that the earphone 1 is not wore by the user, the elastic soft sheath 40 is not squeezed by the ear of the user, thereby not deformed. Therefore, the elastic soft sheath 40 is not in contact with the first and second grounding paths 13 and 14. The power source 5 and the sensing member 30 don't form a complete loop, so the sensing member 30 is disabled from functioning, thereby consuming no power. In contrast, when the user wears the earphone 1, the elastic soft sheath 40 is squeezed by the force applied by the ear of the user and thereby deformed, the first and second grounding paths 13 and 14 are electrically connected with each other, the power source 5, the sensing member 30 and the elastic soft sheath 40 form a closed loop, enabling the sensing member 30 to function. The user then can operate the touch control key 31 by the untouched gesture or touching, thereby controlling the audio member 20. Therefore, when the earphone 1 is not in use, the sensing member 30 is disabled from functioning, preventing form the self-discharge problem of the touch control chip 33 of the traditional earphone. That effectively lowers the power consumption when the earphone 1 is not in use, prolonging the available time of the earphone 1.

Figure 4:
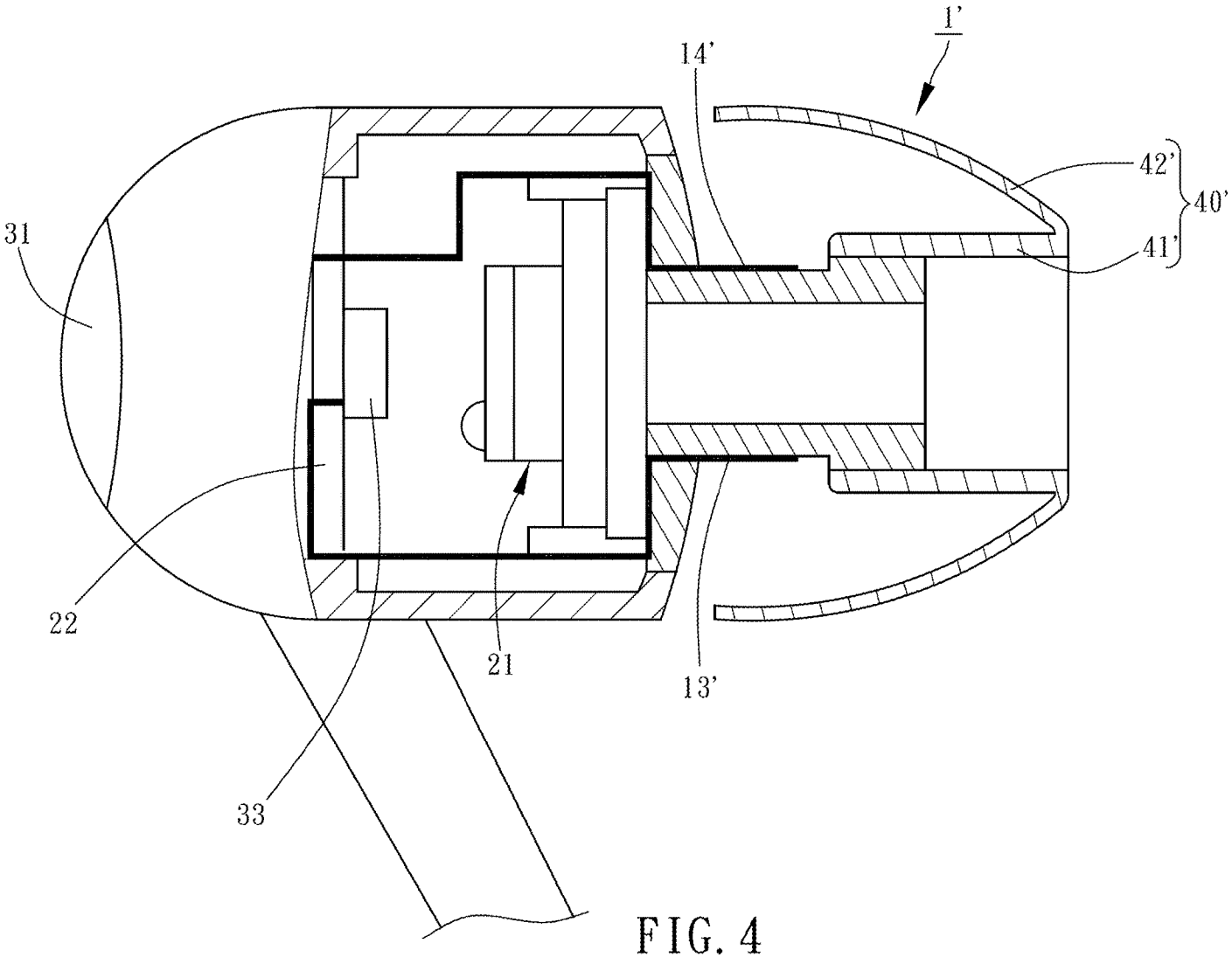
FIG. 4 is a schematic sectional view of the earphone according to a second embodiment of the present invention, showing the condition that the elastic soft sheath is made of electrically conductive material.
Figure 5:
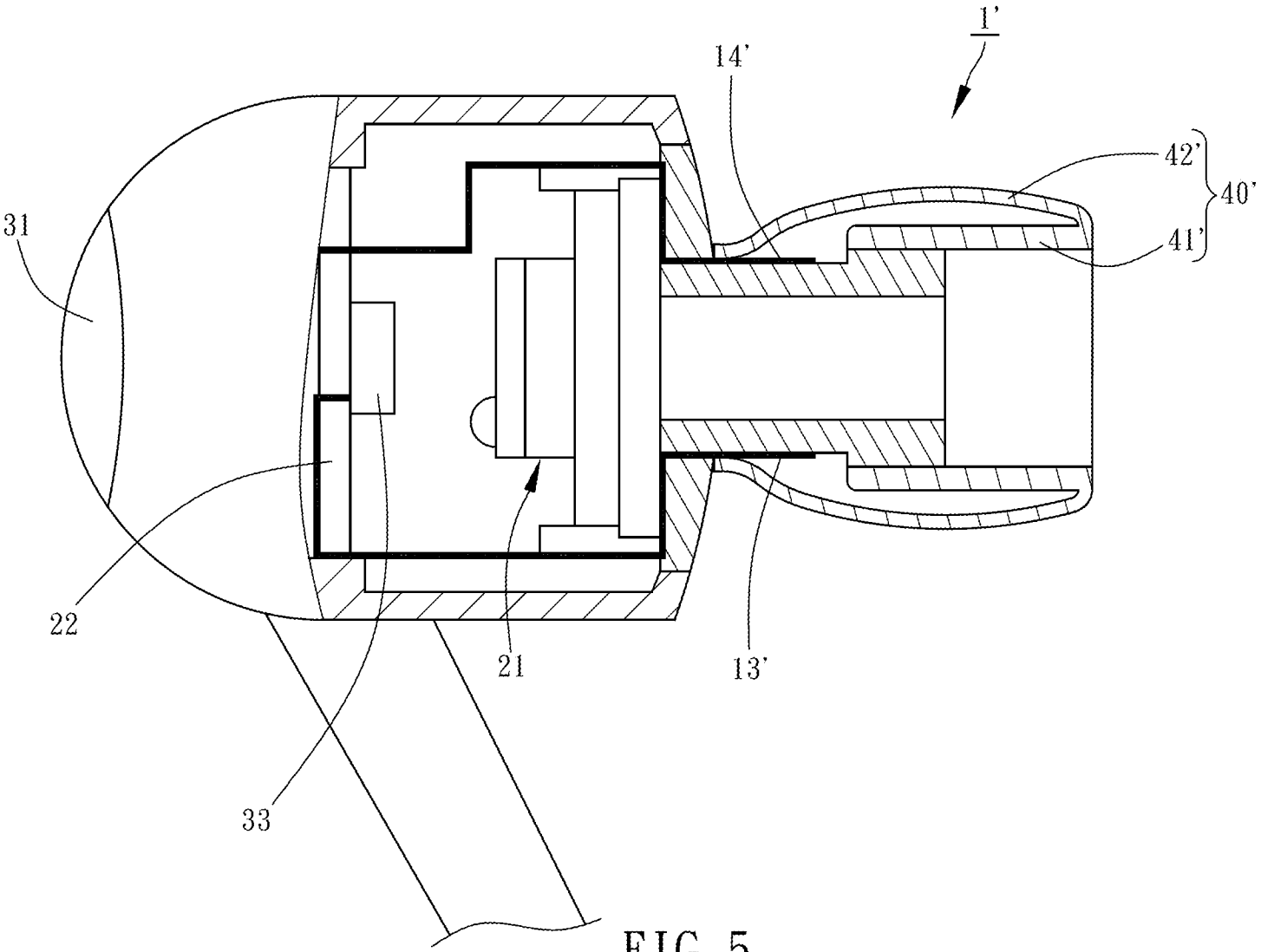
FIG. 5 is similar to FIG. 4, showing the condition that the elastic soft sheath is deformed and in contact with the first and second grounding paths.

The present invention further provides a second embodiment. Referring to FIG. 4 and FIG. 5, the components and effect of the earphone 1' in the second embodiment are similar to that in the first embodiment, but the primary difference therebetween is the whole elastic soft sheath 40' (including the sleeve portion 41' and the outer cover 42') is made of electrically conductive material. Besides, when the elastic soft sheath 40' is not deformed, the elastic soft sheath 40' is not in contact with and electrically connected with the first and second grounding paths 13' and 14' at all (as shown in FIG. 4). When the elastic soft sheath 40' is deformed by the external force, the outer cover 42' is likewise in contact with and electrically connected with the first and second grounding paths 13' and 14' (as shown in FIG. 5). In this way, the earphone 1' is likewise lowered effectively in the power consumption when not in use.

In conclusion, the abovementioned embodiments according to the present invention is certainly effective in lowering the power consumption resulted from the touch control key. Besides, through using the touch control key, the flexibility of designing the earphone is increased. The above are both the features of the present invention.

What is claimed is:

1. A power-saving earphone capable of being driven by a power source to emit sound, the earphone comprising:

a casing having a first grounding path and a second grounding path separately disposed on an exterior surface of the casing;

an audio member comprising a processing unit electrically connected with the first grounding path;

a sensing member comprising a controlling unit electrically connected with the second grounding path; and an elastic soft sheath disposed on a periphery of the casing and capable of being elastically deformed by an external force;

wherein when the elastic soft sheath is not deformed, the elastic soft sheath, the first grounding path and the second grounding path form an open circuit; when the elastic soft sheath is deformed by the external force, the first grounding path is electrically connected with the second grounding path through the elastic soft sheath, and wherein the power source comprises a positive voltage terminal and a ground terminal; the positive voltage terminal of the power source is electrically connected with the processing unit and the controlling unit, and the ground terminal of the power source is electrically connected with the first grounding path; when the elastic soft sheath electrically connects the first grounding path and the second grounding path, the audio member, the sensing member, the power source and the elastic soft sheath jointly form a closed loop.

2. The earphone as claimed in claim 1, wherein the elastic soft sheath has a sleeve portion and an outer cover connected with the sleeve portion; the sleeve portion of the elastic soft sheath is sleeved onto the casing; the outer cover has an electrically conductive portion annularly provided on an outer edge of the outer cover; when the outer cover is deformed by the external force, the electrically conductive portion of the outer cover is in contact with the first grounding path and the second grounding path.

3. The earphone as claimed in claim 2, wherein the sleeve portion is made of electrically insulating material; the outer cover is made of electrically conductive material or coated with an electrically conductive material layer on a surface of the outer cover.

4. The earphone as claimed in claim 2, wherein the elastic soft sheath is made of electrically conductive material.

5. The earphone as claimed in claim 2, wherein the casing further comprises a sound tube and a main body connected with the sound tube; an exterior surface of the sound tube has a first section and a second section; the first grounding path and the second grounding path are extended from an inner wall of the main body to the first section of the sound tube; the sleeve portion is sleeved onto and covers the second section of the sound tube and exposes the first section of the sound tube.

6. The earphone as claimed in claim 5, wherein when the elastic soft sheath is deformed by the external force, the elastic soft sheath is electrically connected with the first section of the sound tube, and the sleeve portion is electrically insulated from the second section of the sound tube.

7. The earphone as claimed in claim 1, wherein the power source is coupled between the processing unit and the controlling unit.

8. The earphone as claimed in claim 1, wherein the power source is a rechargeable battery.

9. The earphone as claimed in claim 1, wherein the sensing member comprises a touch control key provided on the exterior surface of the casing; the controlling unit comprises a touch control chip electrically connected with the touch control key.

10. The earphone as claimed in claim 1, wherein when the elastic soft sheath is deformed by the external force, the processing unit is electrically connected with the controlling unit, thereby enabling the sensing member to function.

11. The earphone as claimed in claim 1, wherein the first grounding path and the second grounding path are made of conductive wire, sheet metal or electrically conductive coated film.

* * * * *